United States Patent [19]

Djezovic

[11] Patent Number: 4,717,024

[45] Date of Patent: Jan. 5, 1988

[54] HOME AND TRAVEL ORGANIZER

[76] Inventor: Vasa Djezovic, 527 W. 48th St., New York, N.Y. 10036

[21] Appl. No.: 847,948

[22] Filed: Apr. 3, 1986

[51] Int. Cl.[4] ..... B65D 21/02

[52] U.S. Cl. ..... 206/581; 206/566; 206/549; 292/42; 150/119; 220/23.4; 220/23.83

[58] Field of Search ..... 206/229, 549, 558, 566, 206/575, 581, 45.15, 45.16; 312/DIG. 33; 292/DIG. 50, 32, 42, 137, 302; 190/127; 150/130, 119; 220/23.4, 23, 23.83, 23.86

[56] References Cited

U.S. PATENT DOCUMENTS

| | | | |
|---|---|---|---|
| 475,977 | 5/1892 | Dillingham | 190/115 |
| 744,664 | 11/1903 | Worth | 190/35 |
| 1,503,378 | 7/1924 | Reid | 132/83 E |
| 2,673,783 | 3/1954 | Rahmet el al. | 220/23 |
| 2,944,694 | 7/1960 | Kinsey | 220/23.83 |
| 3,343,706 | 9/1967 | Berend | 220/23.4 |
| 4,094,431 | 6/1978 | Wheeler | 220/23.86 |
| 4,119,107 | 10/1978 | Pinzone et al. | 132/79 G |
| 4,413,745 | 11/1983 | Stroud | 206/563 |
| 4,550,813 | 11/1985 | Browning | 190/127 |
| 4,576,307 | 3/1986 | Frydenberg | 292/DIG. 50 |

FOREIGN PATENT DOCUMENTS

| | | | |
|---|---|---|---|
| 57680 | 5/1940 | Denmark | 132/79 |
| 1235869 | 5/1960 | France | 190/115 |

*Primary Examiner*—George E. Lowrance
*Assistant Examiner*—Brenda J. Ehrhardt
*Attorney, Agent, or Firm*—Bernard Malina

[57] ABSTRACT

A portable organizer case for jewelry or cosmetics is disclosed comprising a semi-circular dome shaped lid hinged to a receptacle. Within said receptacle is stored a pair of unattached, removeable trays, each fitted with a mounting bracket. When the case is opened, the trays may be removed from the receptacle and may be mounted outwardly astride the end walls of the receptacle to form a dressing table. Within the hollow of the lid is mounted a mirror pivotably rotateable. Lower and upper rails are molded onto the receptacle and lid. When the case is closed, upper and lower rails nest allowing a pair of catches to sealably slide over both rails.

5 Claims, 5 Drawing Figures

HOME AND TRAVEL ORGANIZER

BACKGROUND OF THE INVENTION

The invention concerns a portable organizer case suitable for containing cosmetics, jewelry or similar articles.

Portable organizers of varied shape and description have been known in the art. None of these organizers have, however, been structured to meet all the features desirable in such a product. When employed as a jewelry box or cosmetic make-up kit, the organizer should contain a mirror, preferably a rotateable one. Various sized compartments should be present. Deep compartments may carry such long items as combs, scissors, eyelash tweezers, eye liner pens and make-up brushes. These compartments are also necessary for storing nail polish bottles and other similar smaller liquid containers which must stand upright to avoid spillage. Squat cubicles or drawers should also be present. These compartments are preferable for flat or easily lost items. For instance, there would be stored therein compact cases, eye shadow pallets, bracelets, broaches and earings.

In the past, it was difficult for any single organizer case to contain both deep and squat compartments. Especially difficult has been reconciliation of these differently shaped storage areas with the need for ready accessibility to all items contained therein.

Organizer cases of the present invention are intended for travel or portability in the home. The organizer must serve as more than merely a storage vehicle. It must perform the functions of a dressing table. A mirror must, therefore, be included within the case. This mirror must be free standing, yet pivotable on its holder. Most importantly, a "table" or a work station must temporarily be created upon which may be spread the jewelry selection or cosmetic items for convention access during dressing.

Accordingly, it is an object of the present invention to provide a portable organizer case which has both deep and squat compartments.

Another object of the present invention is to provide a portable organizer whose compartments are arranged so that items held therein are easily accessible.

A further object of this invention is to provide a portable organizer that is readily converted to a temporary dressing table.

These and other objects will become apparent upon consideration of the following detailed description of the invention taken in conjunction with the accompanying drawings.

SUMMARY OF THE INVENTION

A portable organizer for home and travel is provided comprising:

A lid;

A receptacle onto which is hinged said lid;

One or more mirrors are mounted on said lid;

At least one removable tray held within but unattached to said receptacle, said tray having a mounting bracket for attaching said tray to an outer wall of said receptacle.

The organizer case is further characterized by a semicircular dome shaped lid communicating with a receptacle. Protruding through the crest of said lid is a retractable carrying handle.

A lock is positioned outward of the receptacle and lid to seal the case. Two catches are slidably attached along a lower rail molded onto the receptacle. An upper rail, molded onto the lid, fits conformably into a window fashioned from part of the lower rail. When both rails communicate, the catches can be slid over both rails to secure the lid to the receptacle.

Within the hollow lid area is mounted a pair of mirrors, back-to-back, which are pivotable through a 360° arc.

Inside the receptacle are partition walls defining deep compartments each having a depth identical to that of the receptacle. One or more trays are unattachedly lodged within a compartment adjoining the deep compartments. These trays each bear a mounting bracket on an end wall thereof. A dressing table arrangement is formed when a tray is mounted onto and outwardly of a receptacle side wall. Easy access is had to all items within the organizer once the trays are removed therefrom and mounted.

Each bracket comprises a platform perpendicularly located atop an end wall of the tray. A claw juts downward from the platform parallel to the tray end wall. The tray is attached through the claw onto the receptacle wall. To prevent sliding, the claw is split by a gap into two portions which straddle a partition wall perpendicularly attached to the inner surface of the receptacle wall.

DETAILED DESCRIPTION OF THE INVENTION

Figure 1:
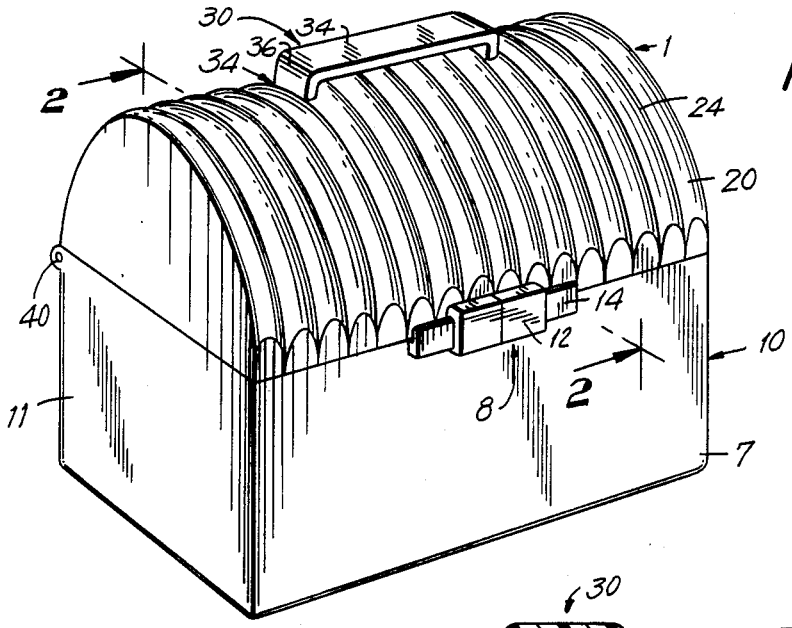
FIG. 1 is a side elevational perspective view of the organizer case with lid in the closed position.

An embodiment of the present invention is illustrated in FIG. 1. A portable organizer, generally identified as 1, is shown having a box shape. Organizer 1 has an elongated semi-circular dome shaped lid 20, bearing a similarity to an aircraft hangar configuration. Lid 20 is attached through hinge 40 to a receptacle 10. As part of lid 20 there are a plurality of ribs 24 each defining a semi-circular arc and lying in parallel rows along the length of lid 20.

A handle 30 is positioned at the uppermost projection, i.e. the dome zenith, of lid 20. Handle 30 has a broad gripper bar 32 that extends in the lengthwise direction along lid 20 and lies perpendicular across a plurality of rib rows 24. Molded at right angles onto either end of gripper bar 32 is a support bar 36 that penetrates rectangular appertures 34 formed in lid 20. Flange 38, formed on the lower terminus of support bar 36, serves as a stop and anchors handle 30 into lid 20. Appertures 34 permit handle 30 to be moved towards or away from lid 20. In the outstretched position, handle 30 is fully extended away from lid 20. Under this configuration, flange 38 bears against surface 22, the underside of lid 20. Normally, the organizer case is transported by gripping handle 30 in the outstretched position. For compactness, when not in transport, handle 30 may be retracted along its width. When in the retracted position, support bars 36 project for most of their length within the dome shaped hollow 42 formed by lid 20.

A lock, generally identified as 8, latches lid 20 to receptacle 10. Lock 8 comprises a lower rail 14 molded onto the upper perimeter of wall 7, one of the two longer walls of receptacle 10. Portions of rail 14 protrude above lip 13, said lip defining the upper limits of wall 7. An indentation 18 is formed at the mid point of rail 14. Lip 13 lies flush with indentation 18. An upper rail 16 is molded onto the lower perimeter of lid 20 on a side opposite to that where hinge 40 is attached. When lid 20 is seated onto receptacle 10, the upper rail 16 conformably inserts into indentation 18. Catches 12 are slideably attached to lower rail 14 and in open position are situated at either ends of lower rail 14. After rail 16 is seated within indentation 18, lock 8 can be closed by sliding catches 12 together so that they overhang parts of both rails 14, 16.

Figure 2:
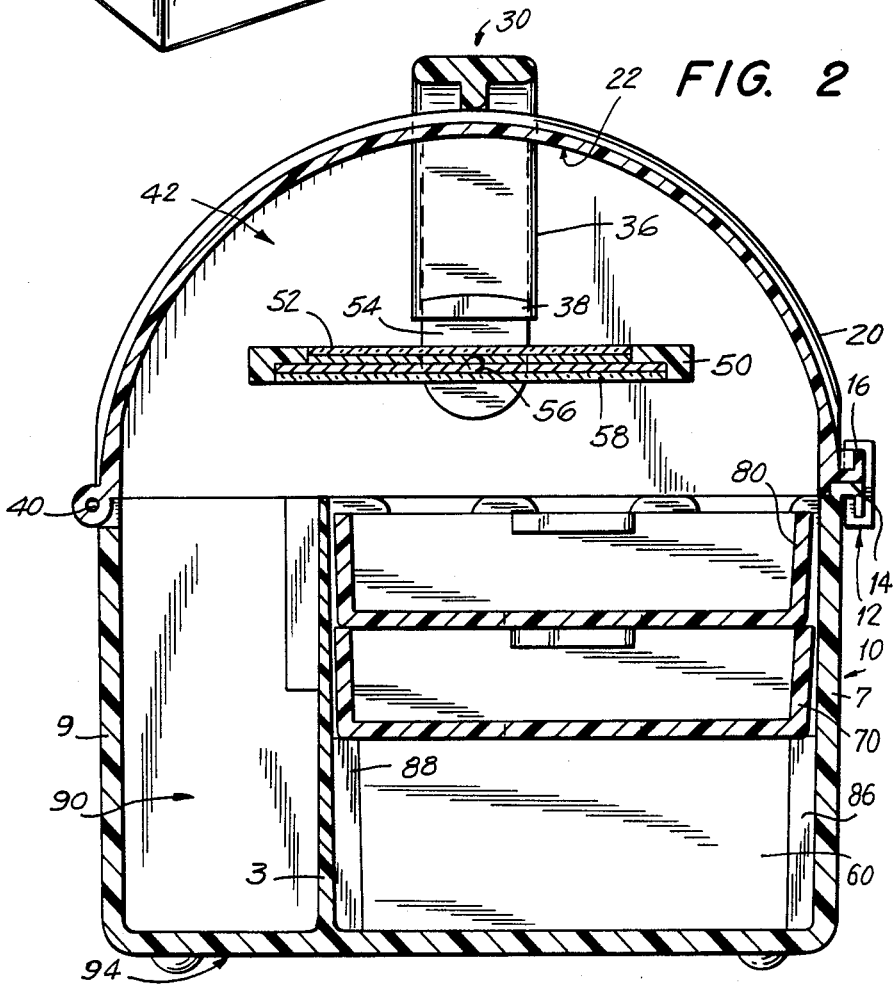
FIG. 2 is a cross-sectional view through the organizer case, as shown in FIG. 1, taken along the line 2—2.

Stationed within hollow 42, formed by lid 20, is a flat mirror 58 and a magnifying mirror 52. These mirrors are held back-to-back within a frame 50. In turn, frame 50 is cradled through pivots 56 at opposite ends of said frame between a pair of support arms 54. FIG. 2 best illustrates these features. Arms 54 are perpendiularly attached to surface 20 and positioned essentially outwards of, but parallel to, the handle support bars 36. Frame 50 may be rotated in a 360° arc on pivots 56. Rotation not only allows ready angle adjustment but also permits easy interchange between mirrors 52 and 58.

Different sized chambers have been arranged within receptacle 10. A pair of deep compartments 90 are formed along the inside rear wall 9 and side walls 11 of receptacle 10. These compartments are further defined by partition walls 2, 3 and 4. Deep compartments 30 are of a depth equivalent to the distance between hinge 40 and the floor 94 of receptacle 10.

Adjoining compartments 90 is a compartment 60 defined by walls 3, 7 and 11. Pairs of ledges 86 and 88 protrude inward from walls 3 and 7, respectively. These ledges rise to approximately half the height of their respective walls.

Within compartment 60 are located a pair of identical trays 70 and 18. Tray 70 rests against ledges 86 and 88 within compartment 60. Tray 80 is supported by and in fact directly above tray 70. Each tray has a depth approximately one quarter the height of walls 3 or 7. Both trays sit freely, unattached, within receptacle 10.

Figure 3:
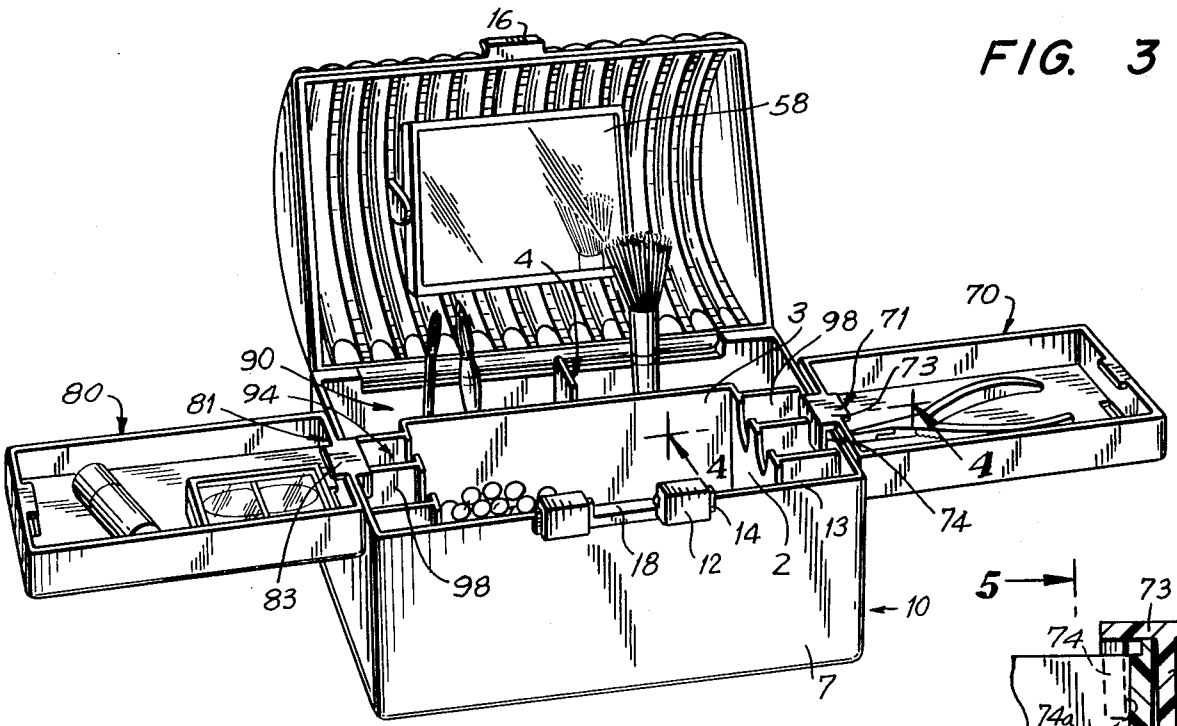
FIG. 3 is a front perspective view of the organizer case, lid open, with mounted mirror and two trays attached outwardly to either side of the receptacle forming a dressing table.
Figure 4:
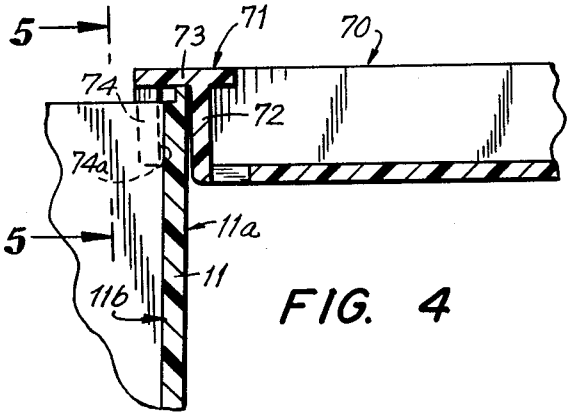
FIG. 4 is an exploded fragmentary cross-sectional view of the tray and mounting bracket which attaches to the receptacle wall, shown in FIG. 3, taken along line 4—4.
Figure 5:
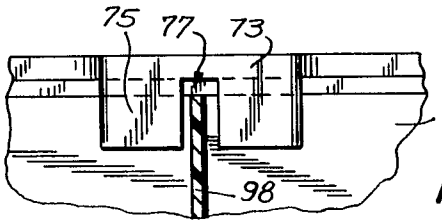
FIG. 5 is an exploded fragmentary end-face view of the mounting brackct overhanging an inside wall of the receptacle, as shown in FIG. 4, taken along line 5—5.

In converting organizer case 1 to a dressing table, lid 20 is opened and pivoted to its fully extended position. Complete extension occurs at an angle approximately 100° removed from the closed position. See FIG. 3. Now trays 70 and 80 may be removed and attachedly positioned, one each, astride side walls 11. Attachment is achieved by a mounting means 71 or 81 integrally molded to an end wall 72 or 82 of the respective trays. Mounting means 71 or 81, best shown in detail by FIGS. 4 and 5, comprises a platform 73 or 83 located atop and perpedicular to end walls 72 or 82. A claw 74 or 84 juts downward from platform 73 or 83 and travels perpendicularly thereto. Claw 74 or 84 is split into a pair of digits 75 or 85 separated by an opening 77 or 87.

When tray 70 or 80 is mounted, end walls 72 or 82 will face the outward surface **11*a* of receptacle wall 11. Platform 73 or 83 will overhang wall 11 and the inner surface 74*a* or 84*a* of claw 74 or 84 will face the inner surface 11*b* of wall 11. To prevent sliding along the upper edge of wall 11, gap 77 or 87 of claw 74 or 84 is positioned to straddle either side of a partition wall 98. The partition wall 98 is aligned at right angles to inner surface 11*b* of wall 11**.

What is claimed:

1. A portable organizer comprising: a lid, a receptacle onto which is hinged said lid; at least one mirror mounted on said lid; two removable trays held within but unattached to said receptacle, each of said trays having a mounting bracket for attaching said tray to an outer wall of said receptacle, one tray stackable upon another and stored in a compartment of said receptacle, said mounting bracket comprising a claw positioned perpendicular to and overlapping said outer wall, said claw formed as a pair of digits separated by a gap, said receptacle being divided by one or more partition walls into a series of compartments, one of said partition walls being aligned at right angles to an inner surface of said outer wall, said digits each adapted to straddle a different side of said partition wall when said tray is attached to said outer wall, said series of compartments comprising at least one deep compartment and one squat compartment, said deep compartment extending the full depth of said receptacle, two or more ledges protruding from said outer wall, said ledges being no higher than half the height of said partition wall and said trays supported on said ledges.

2. An organizer according to claim 1 wherein said lid is an elongated semi-circular dome shaped structure and further comprises a plurality of ribs formed to define a semi-circular arc, being pivotally mounted underneath said lid and rotateable through 360° arc.

3. An organizer according to claim 2 wherein a second mirror is present, said first and second mirrors being positioned back-to-back, said second mirror being a magnifying mirror.

4. An organizer according to claim 1 further comprising a handle communicating with said lid, said handle positioned at the uppermost projection of said lid, said handle comprising a gripper bar and a pair of support bars molded onto opposite ends of said gripper bar, said support bars penetrating said lid through a pair of apertures formed on said lid, said gripper bar being perpendicularly moveable away and towards said lid.

5. An organizer according to claim 4 further comprising a lock means, said lock means formed from a lower rail molded to said receptacle, an upper rail molded to said lid, a window cut into said lower rail, the said upper rail fitting conformably into said window when said lid is in a closed position, and a pair of catches slideably moveable across said lower rail and over said upper rail when positioned in said window.

* * * * *